US005232187A

United States Patent [19]

O'Farrell et al.

[11] Patent Number: 5,232,187

[45] Date of Patent: Aug. 3, 1993

[54] PAINTER'S HELPER

[76] Inventors: John B. O'Farrell, 6320 Baltimore Pike, Littlestown, Pa. 17340; George Spector, 233 Broadway Rm. 702, New York, N.Y. 10279

[21] Appl. No.: 927,065

[22] Filed: Aug. 10, 1992

[51] Int. Cl.[5] ..... A47G 23/02

[52] U.S. Cl. ..... 248/148; 248/237

[58] Field of Search ..... 248/148, 238, 237, 371, 248/130, 146, 210; 182/45

[56] References Cited

U.S. PATENT DOCUMENTS

| | | | |
|---|---|---|---|
| 606,100 | 6/1898 | Thompson | 248/148 X |
| 789,034 | 5/1905 | Jones | 248/238 X |
| 1,159,372 | 11/1915 | Goff | 248/148 X |
| 1,650,433 | 11/1927 | Dages | 248/237 X |
| 4,695,023 | 9/1987 | McCafferty | 182/45 X |
| 4,929,488 | 5/1990 | Livi | 248/188.9 X |

*Primary Examiner*—J. Franklin Foss

[57] ABSTRACT

A device is provided for leveling and stabilizing a paint bucket on an inclined surface, which consists of a wedge-shaped housing having a cavity formed in an upper surface for insertion of the paint bucket therein. A non-slip base plate is affixed to a lower surface of the wedge-shaped housing to prevent slippage of the lower surface of the wedge-shaped housing on the inclined surface. A mechanism is for carrying the wedge-shaped housing with the paint bucket and the non-slip base plate, so that the device can be transported from place to place by gripping the carrying mechanism with a hand of a person.

2 Claims, 1 Drawing Sheet

PAINTER'S HELPER

BACKGROUND OF THE INVENTION

The instant invention relates generally to support mechanisms and more specifically it relates to a device for leveling and stabilizing a paint bucket on an inclined surface, which provides a structure to prevent the paint bucket from wobbling and tipping over.

There are available various conventional support mechanisms which do not provide the novel improvements of the invention herein disclosed.

SUMMARY OF THE INVENTION

A primary object of the present invention is to provide a device for leveling and stabilizing a paint bucket on an inclined surface that will overcome the shortcomings of the prior art devices.

Another object is to provide a device for leveling and stabilizing a paint bucket on an inclined surface, such as a roof, in order to prevent the paint bucket from wobbling and tipping over, so that the paint will not spill therefrom.

An additional object is to provide a device for leveling and stabilizing a paint bucket on an inclined surface, in which the wedge shaped housing and non-slip base will keep the paint bucket in a proper stationary upright position with respect to the inclined surface.

A further object is to provide a device for leveling and stabilizing a paint bucket on an inclined surface that is simple and easy to use.

A still further object is to provide a device for leveling and stabilizing a paint bucket on an inclined surface that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
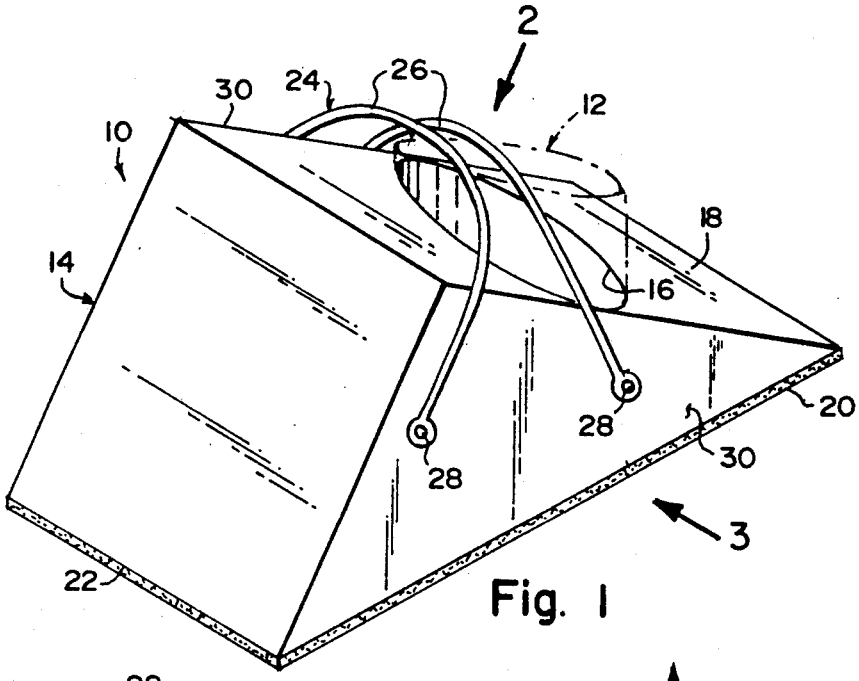
FIG. 1 is a perspective view of the instant invention.

Turning now descriptively to the drawings, in which similar reference characters denote similar elements throughout the several views, the Figures illustrate a device 10 for leveling and stabilizing a paint bucket 12 on an inclined surface, which consists of a wedge-shaped housing 14 having a cavity 16 formed in an upper surface 18 for insertion of the paint bucket 12 therein. A non-slip base plate 20 is affixed to a lower surface 22 of the wedge-shaped housing 14 to prevent slippage of the lower surface 22 of the wedge-shaped housing 14 on the inclined surface, such as a roof and the like. A mechanism 24 is for carrying the wedge-shaped housing 14 with the paint bucket 12 and the non-slip base plate 20, so that the device 10 can be transported from place to place by gripping the carrying mechanism 24 with a hand of a person.

The wedge-shaped housing 14 is fabricated out of a lightweight durable strong material, while the non-slip base plate 20 is fabricated out of a soft sponge material.

The carrying mechanism 24 includes a pair of handles 26, each pivotally attached at opposite ends 28 to the vertical sides 30 of the wedge-shaped housing 14, so that the handles 26 can be gripped and carried by the hand of the person.

Figure 4:
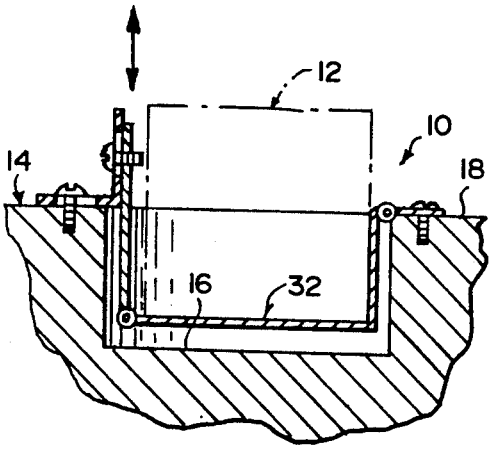
FIG. 4 is a cross sectional view taken along line 4—4 in FIG. 2 of a modification showing an adjustable paint bucket holder within the cavity of the wedge-shaped housing.

The device 10, as shown in FIG. 4, further includes a holder 32 for the paint bucket 12, adjustably mounted onto the upper surface 18 of the wedge-shaped housing 14 and extending within the cavity 16. When the paint bucket 12 is inserted within the cavity 16, the holder 32 can be adjusted to realign the paint bucket 12 to stand in a more upright position with respect to a varying angle of the inclined surface.

Figure 2:
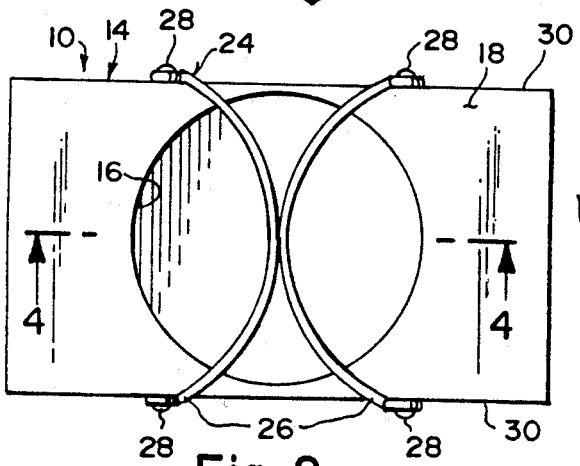
FIG. 2 is a top view taken in direction of arrow 2 in FIG. 1.
Figure 3:
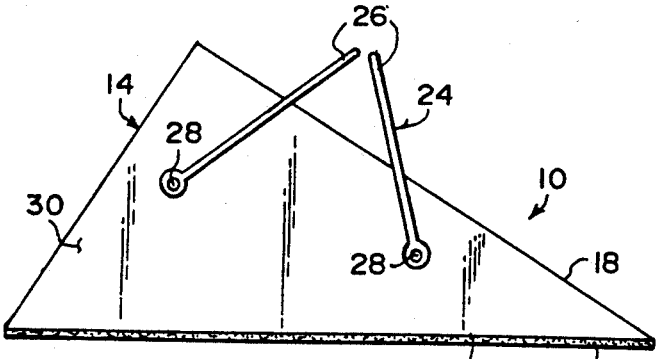
FIG. 3 is a side view taken in direction of arrow 3 in FIG. 1.

The handles 26, as shown in FIGS. 1, 2 and 3 are curved, but they can also be bent as in an inverted U-shaped configuration, which will allow for more room when using a paint brush. Fasteners such as endless bolts are cut off to reach from side to side of the wedge-shaped housing 14, which will help to strengthen the wedge-shaped housing 14 somewhat.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device for leveling and stabilizing a paint bucket on an inclined surface which comprises:

a) a wedge-shaped housing having an upper surface with a cavity formed therein for insertion of the paint bucket and a lower surface for engaging said inclined surface, including parallel, vertical sides connecting said upper and lower surfaces;

b) a non-slip base plate affixed to said lower surface to prevent slippage of said lower surface housing on said inclined surface;

c) means for carrying said wedge-shaped housing with the paint bucket plate, so that said device can be transported from place to place by a person; wherein said carrying means includes a pair of opposing handles, each handle pivotally attached at opposite ends to said vertical sides, wherein said handles extend symetrically over said cavity; further including a holder for said paint bucket adjustably mounted on said upper surface of said wedge-shaped housing and extending adustably within the cavity, so that when the paint bucket is inserted within the cavity, said holder can be adjusted to align the paint bucket vertically with respect to said inclined surface.

2. A device as in claim 1, wherein said handles are pivoted about parallel axis spaced apart approximately the width of said cavity.

* * * * *